US005982340A

United States Patent [19]

Troche

[11] Patent Number: 5,982,340

[45] Date of Patent: Nov. 9, 1999

[54] SATELLITE ANTENNA MOUNTING DEVICE

[75] Inventor: George Troche, Meriden, Conn.

[73] Assignee: Rosa E. Carrero DBS Hispanic Media & Marketing Specialists, Meriden, Conn.

[21] Appl. No.: 08/955,347

[22] Filed: Oct. 21, 1997

[51] Int. Cl.[6] ..... H01Q 3/08

[52] U.S. Cl. ..... 343/882; 343/890

[58] Field of Search ..... 343/840, 882, 343/878, 880, 714, 757, 758, 720, 890; H01Q 1/12, 3/08

[56] References Cited

U.S. PATENT DOCUMENTS

| | | | |
|---|---|---|---|
| 1,682,180 | 8/1928 | Merrill | 248/462 |
| 2,543,221 | 2/1951 | Barany | 248/281 |
| 2,956,280 | 10/1960 | O'Keefe et al. | 343/882 |
| 4,050,661 | 9/1977 | Wooldridge | 248/285 |
| 4,628,323 | 12/1986 | Crean | 343/765 |
| 4,892,278 | 1/1990 | Huang | 248/124 |
| 4,932,620 | 6/1990 | Foy | 248/124 |
| 5,061,945 | 10/1991 | Hull et al. | 343/840 |
| 5,355,145 | 10/1994 | Lucas | 343/882 |
| 5,363,116 | 11/1994 | Allen | 343/881 |
| 5,526,010 | 6/1996 | Plunk | 343/882 |
| 5,576,722 | 11/1996 | Bustillos | 343/882 |

*Primary Examiner*—Michael C. Wimer
*Attorney, Agent, or Firm*—Bachman & LaPointe, P.C.

[57] ABSTRACT

A satellite dish mounting system for mounting indoors and extending outdoors through a window. The device includes a vertical support member having a lower end mounted indoors on a supporting surface, a horizontal support member having a first end affixed to the vertical support member and extending from the vertical support member through a window and outside the building, and having a second end outside the building, and a satellite antenna dish mounted on the second end of the horizontal support member.

11 Claims, 5 Drawing Sheets

SATELLITE ANTENNA MOUNTING DEVICE

BACKGROUND OF THE INVENTION

The present invention relates to a satellite mounting device which enables the satellite antenna dish to be mounted through a window of a building.

Portable satellite antenna systems are well known, see, for example, U.S. Pat. Nos. 5,061,945, 5,526,010, 5,576,722 and 5,363,116. These generally include support legs for mounting in an outdoor environment, as by staking a mounting means to the ground. In addition, satellite dish actuators are known, as, for example, in U.S. Pat. No. 5,355,145, but these also involve outdoor mounting.

In addition, a variety of rotating brackets are known, as, for example, in U.S. Pat. Nos. 4,932,620, 1,682,180, 2,543,221 and 4,892,278. But these are not responsive to problems associated with satellite mounting.

Accordingly, it is a principal objective of the present invention to provide an improved satellite mounting device.

It is a further object of the present invention to provide a satellite mounting device as aforesaid for mounting the satellite dish through a window of a building, with mounting means located indoors.

It is a still further object of the present invention to provide a satellite mounting device as aforesaid which is inexpensive, simple and convenient to assemble and display, and simple and convenient to disassemble.

Further objects and advantages of the present invention will appear hereinbelow.

SUMMARY OF THE INVENTION

The foregoing objects and advantages are readily obtained in accordance with the present invention.

The satellite dish mounting system of the present invention comprises: a substantially vertical support member having a lower end mounted on a support surface inside a building; a substantially horizontal support member having a first end affixed to said vertical support member and extending from said vertical support member through a window and outside said building, and having a second end located outside said building; means on said horizontal support member intermediate said first and second ends to engage a window frame; and a satellite antenna dish mounted on said second end of the horizontal support member.

Further features of the present invention and advantages thereof will appear hereinbelow.

BRIEF DESCRIPTION OF THE DRAWINGS

The present invention will be more readily understood from a consideration of the following exemplificative drawings, wherein.

DETAILED DESCRIPTION OF PREFERRED EMBODIMENTS

Figure 1:
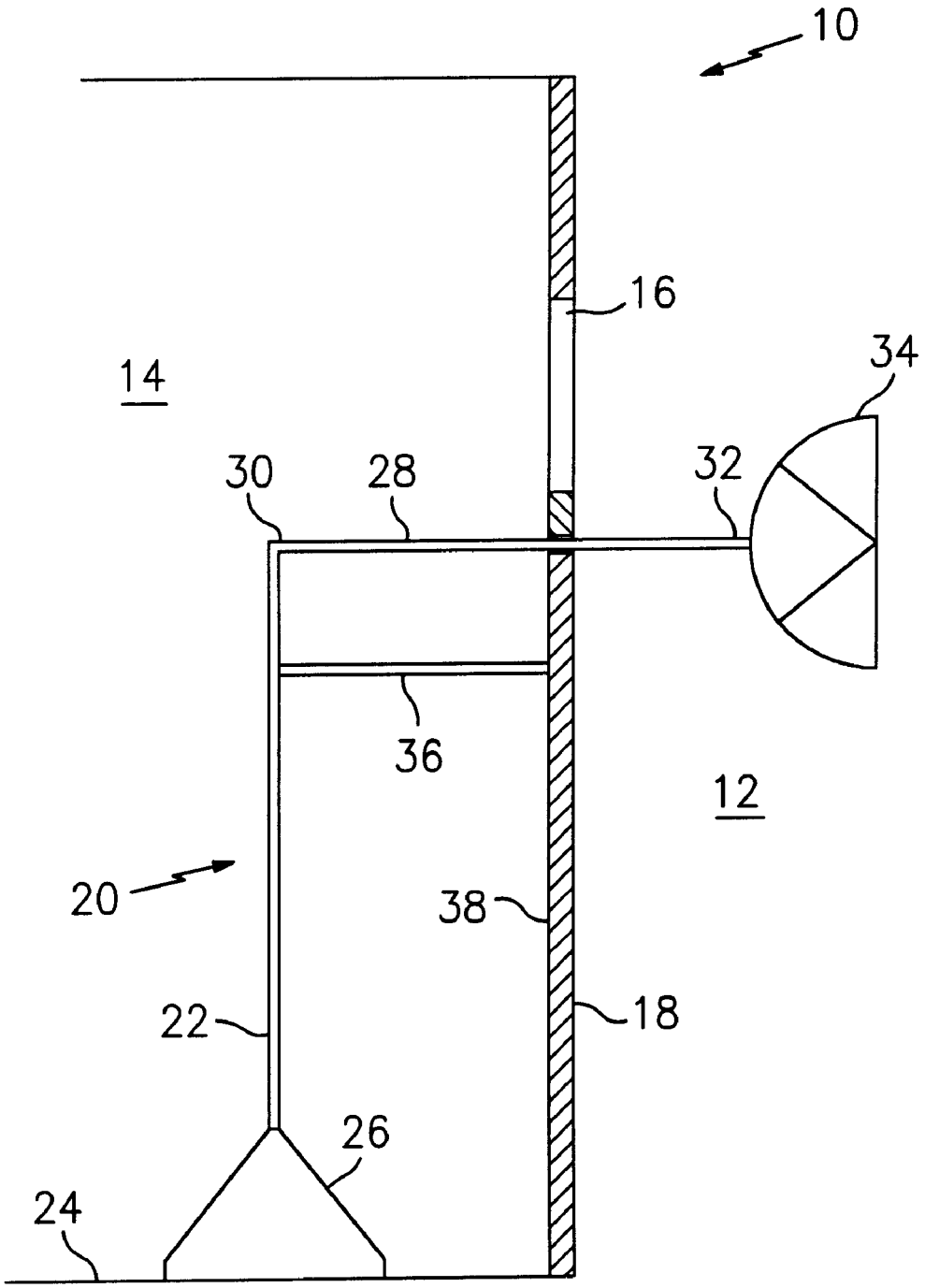
FIG. 1 is a partly schematic view of the system of the present invention.

In accordance with the partly schematic view of FIG. 1, building 10 includes an exterior 12 and an interior 14 with a window 16 on a building surface 18. Satellite mounting system 20 of the present invention includes a vertical support member 22, which may be adjusted up or down, mounted on a building supporting surface inside the building, as floor 24 via stand 26. Substantially horizontal support member 28 is affixed to vertical support member 22 at a first end 30 of the horizontal support member and extends from the vertical support member through window 16 to the building exterior 12. Horizontal support member 28 includes a second end 32 spaced from first end 30 and located in the building exterior. Satellite antenna dish 34 is mounted on second end 32 so that it is conveniently located outside building 10. Optionally, brace 36 may be connected between vertical member 22 and inside building wall 38. Naturally, appropriate electrical connections are provided, as is well known.

Thus, the present invention provides a simple and convenient means for mounting a satellite dish without the difficulty and expense of a rigid building mounting. The dish is easily situated through a window and is particularly useful in for example an apartment or other buildings where such facilities are not available or are prohibitively expensive. Moreover, this can be accomplished in a simple and convenient manner without building damage, and easily installed and disassembled by an individual.

The satellite dish 32 is adjustable up and down and left and right in order to obtain the best signal, and the horizontal support member is desirably adjustable in and out.

Figure 2:
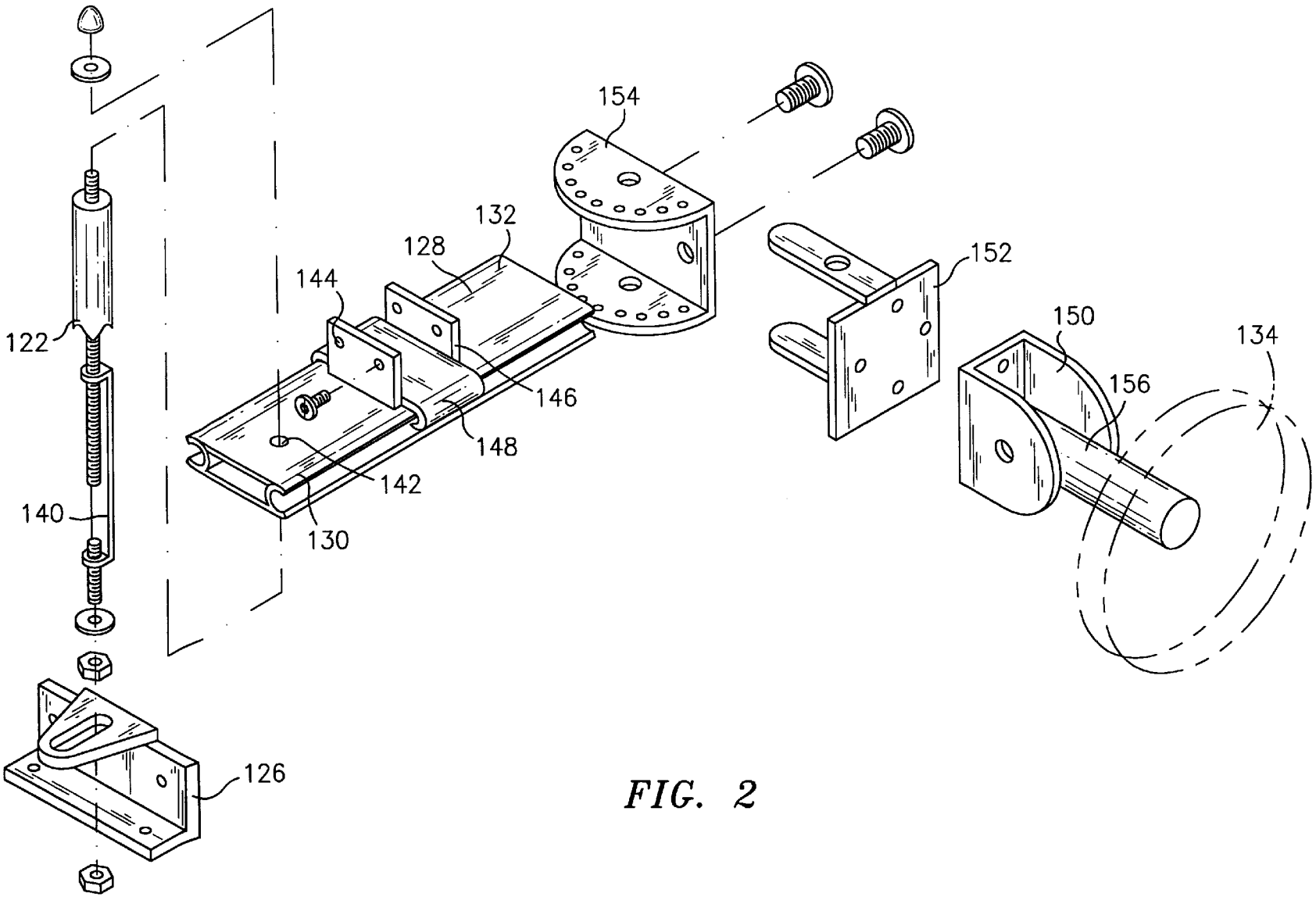
FIG. 2 is a disassembled view of one embodiment of the present invention.

FIG. 2 shows a disassembled view of one embodiment of the present invention, including attachment plate 126 which may be configured to be affixed to the floor or sidewall or base board and adjustable vertical support member 122 including adjustment means 140 to adjust the height thereof. Horizontal support member 128 having a first end 130 provided with means 142 to be affixed to the vertical support member and a second end 132 for attachment to satellite antenna 134 (shown in phantom). Horizontal member 128 includes spaced apart, upstanding members 144, 146 with sealing means 148 therebetween situated between first end 130 and second end 132 for engagement with a window frame (not shown in FIG. 2) to enable the horizontal member to extend outside the window and to close the window in sealing relationship with members 144, 146 and 148. Means may be provided to allow the user to firmly lock the window. Antenna 134 is affixed to second end 132 via attachment plates 150, 152 and 154 which enable adjustment of the dish left to right via adjustable plate 154 and up and down via attachment bar 156 affixed to plate 150. Naturally, other specific means of attachment may be readily provided to enable easy and convenient adjustment of the dish 134 left to right and up and down. The electrical connections have been omitted for clarity.

It can be readily seen that this provides a simple and convenient system for mounting a satellite dish.

Figure 3:
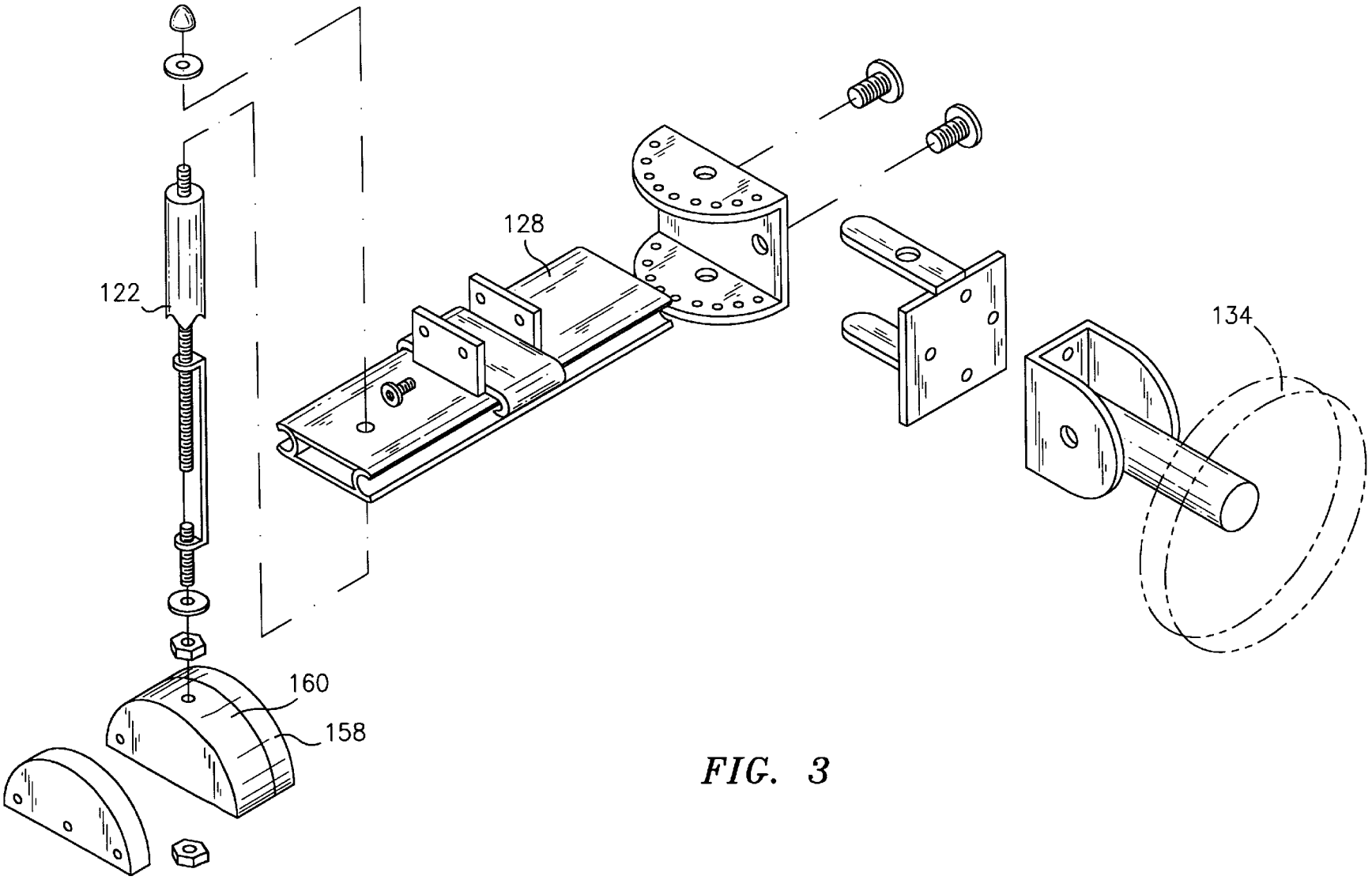
FIG. 3 is a view similar to FIG. 2 of an alternate embodiment of the present invention.
Figure 5:
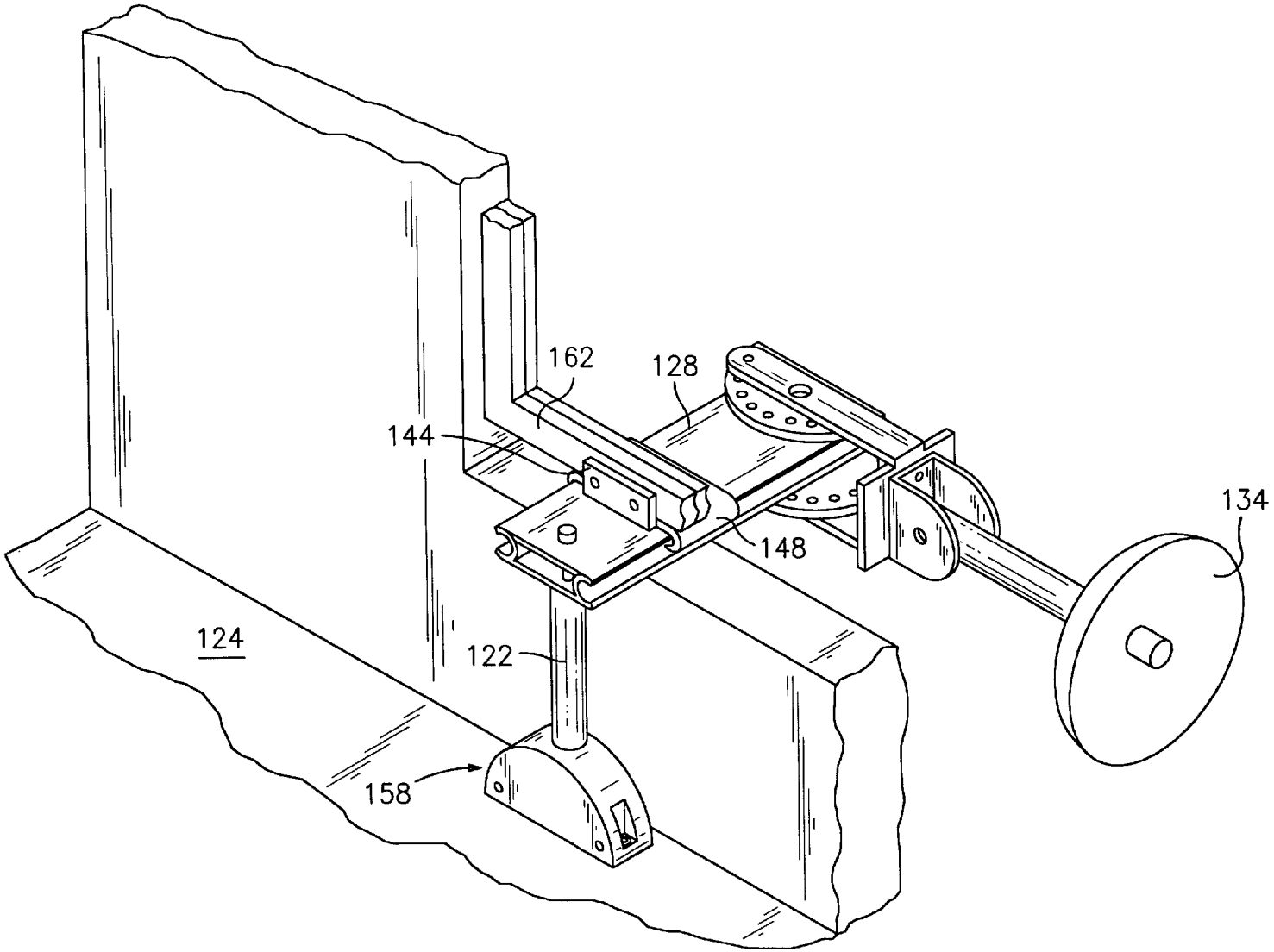
FIG. 5 is a perspective view of the embodiment of FIG. 3 in the assembled state.

FIG. 3 shows an alternate embodiment similar to FIG. 2 using a stand 158, which may be weighted, as with base weight 160, for attachment to vertical support member 122, which in turn is affixed to horizontal support member 128, which in turn is affixed to satellite dish 134 as in FIG. 2. FIG. 5 shows the embodiment of FIG. 3 in assembled and operational configuration, with stand 158 on building floor 124, and the members 144, 146 and 148 (outside member 146 not shown in FIG. 5) of horizontal support member 128 engaging window frame 162 in sealing relationship therewith. Adjustable satellite dish 134 is mounted to the horizontal support member outside of the building.

Figure 4:
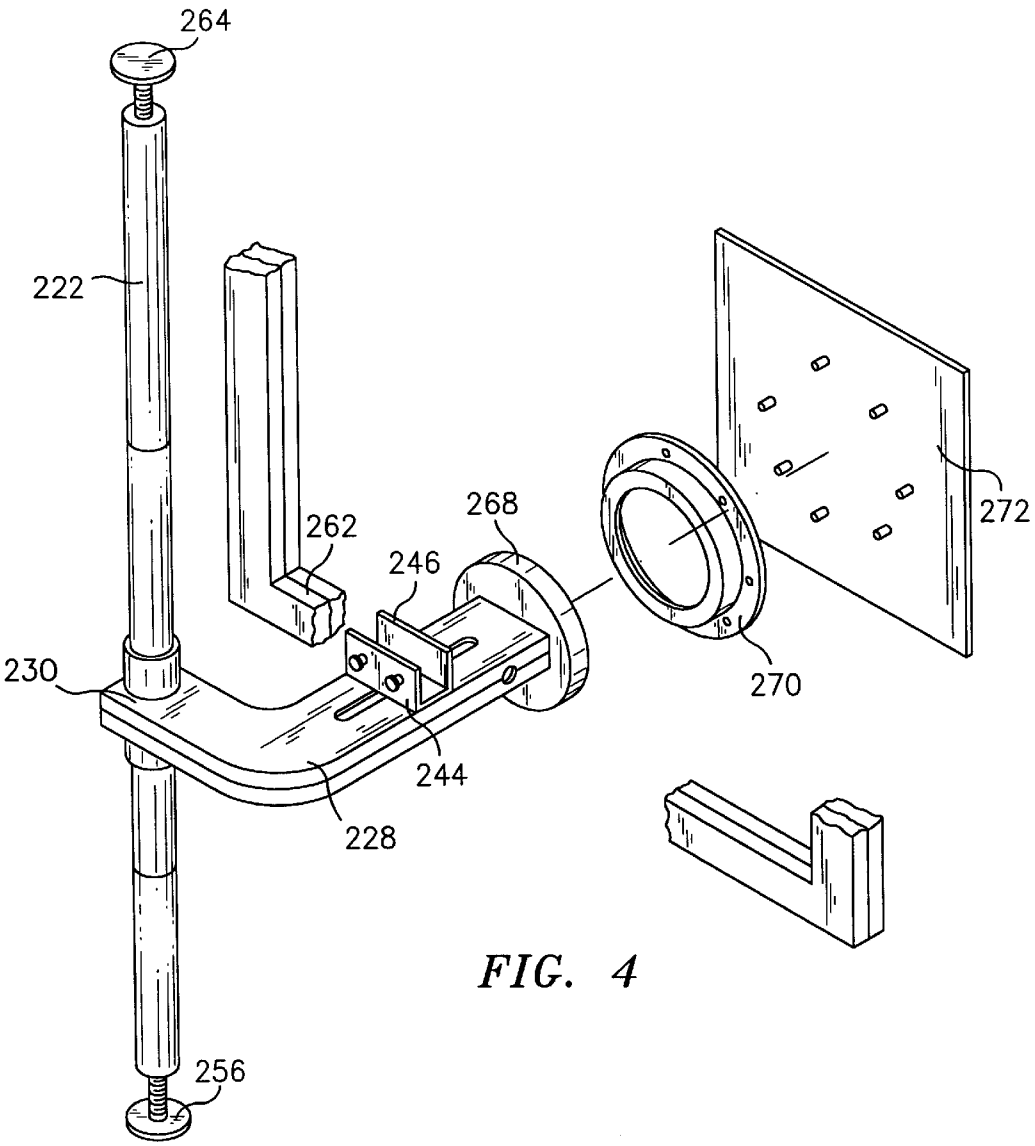
FIG. 4 is a partial view similar to FIG. 2 of a still further embodiment of the present invention.

The alternate embodiment of FIG. 4 shows adjustable vertical support member 222 with adjustable ceiling engagement member 164 and adjustable floor engagement member 166. Curved horizontal support member 228 includes spaced apart upstanding members 244, 246 for engagement with window frame 262. The first end 230 of horizontal support member 228 is affixed to the vertical support member 222, and the second end 232 is for engagement with an adjustable satellite dish (not shown in FIG. 4) via mounting means 268, 270 and 272.

Thus, the embodiment of FIG. 4 shows a simple and convenient satellite dish mounting system, as with the other embodiments, with means for adjusting same, and also including an inside support system with means for engaging the floor and ceiling.

Metal members with a decorative finish are preferred to provide firm support, but plastic may be used especially for exterior surfaces to provide a desirable aesthetic finish.

Naturally, many variations may be provided within the scope of the present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A satellite dish mounting system for removably mounting an outside satellite dish within the space inside a building, which comprises:

a substantially vertical support member extending within the space inside a building and having a lower end mounted on a supporting wall or floor surface inside the space in said building, wherein the vertical support member is at least in part spaced from the supporting surface;

a substantially horizontal support member having a first end affixed to said vertical support member and extending into the space in said building and extending from said vertical support member through a window and outside said building, said horizontal support member having a second end located outside said building;

means on said horizontal support member spaced from said first and second ends to engage a window frame of said window in sealing relationship therewith; and a satellite antenna dish adjustablye mounted on said second end of the horizontal support member.

2. A system according to claim 1, wherein said vertical support member includes an upper end with means for engaging a ceiling inside a building and a lower end with means for engaging a floor inside a building.

3. A system according to claim 1, including a mounting stand engaging the lower end of the vertical support member.

4. A system according to claim 1, including means for pivotally mounting said satellite antenna on the second end of said horizontal support member.

5. A system according to claim 1, wherein said vertical support member is adjustable.

6. A system according to claim 1, wherein said means to engage a window frame includes spaced apart, vertically upstanding members for engaging opposed sides of a window frame.

7. A system according to claim 1, including a brace affixed to the vertical support member for engaging an inside building surface.

8. A system according to claim 1, wherein said vertical support member includes an adjustable floor engaging means.

9. A system according to claim 1, wherein said vertical support member includes an adjustable ceiling engaging means.

10. A system according to claim 1, wherein said horizontal support member is curved.

11. A system according to claim 1, wherein said mounting system is portable.

* * * * *